US006298780B1

(12) United States Patent
Ben-Horin et al.

(10) Patent No.: US 6,298,780 B1
(45) Date of Patent: Oct. 9, 2001

(54) PLATELESS PRINTING SYSTEM

(75) Inventors: Narda Ben-Horin, Tel-Aviv; Murray Figov, Ra'anana, both of (IL)

(73) Assignee: Scitex Corporation Ltd., Herzelia (IL)

( * ) Notice: Subject to any disclaimer, the term of this patent is extended or adjusted under 35 U.S.C. 154(b) by 0 days.

(21) Appl. No.: 09/396,036

(22) Filed: Sep. 15, 1999

Related U.S. Application Data

(63) Continuation-in-part of application No. PCT/IL99/00026, filed on Jan. 14, 1999.

(30) Foreign Application Priority Data

Jan. 15, 1998 (IL) ..... 122953

(51) Int. Cl.[7] ..... B41C 1/10

(52) U.S. Cl. ..... 101/478; 101/457; 101/463.1; 101/467; 430/303

(58) Field of Search ..... 101/457, 462, 101/463.1, 465–467, 478; 430/302, 303

(56) References Cited

U.S. PATENT DOCUMENTS

| | | | | |
|---|---|---|---|---|
| 3,511,178 | | 5/1970 | Curtin | 101/457 |
| 3,624,227 | | 11/1971 | Hwang | 430/302 |
| 3,741,118 | | 6/1973 | Carley | 101/451 |
| 4,038,226 | | 7/1977 | Towle et al. | 525/517.5 |
| 4,080,897 | | 3/1978 | Gundlach | 101/467 |
| 4,473,676 | * | 9/1984 | Steklenski | 430/272 |
| 4,501,810 | | 2/1985 | Fromson et al. | 430/302 |
| 4,718,340 | | 1/1988 | Love, III | 101/467 |
| 4,731,317 | | 3/1988 | Fromson et al. | 430/159 |
| 5,129,321 | | 7/1992 | Fadner | 101/467 |
| 5,188,033 | | 2/1993 | Fadner | 101/467 |
| 5,206,102 | | 4/1993 | Tench | 101/456 |
| 5,212,048 | * | 5/1993 | Lewis et al. | 430/272 |
| 5,213,041 | | 5/1993 | Kanck | 101/450.1 |
| 5,213,931 | | 5/1993 | Staples et al. | 430/102 |
| 5,310,869 | * | 5/1994 | Lewis et al. | 430/272 |
| 5,333,548 | | 8/1994 | Fadner | 101/467 |
| 5,334,486 | * | 8/1994 | Abe et al. | 430/303 |
| 5,339,737 | | 8/1994 | Lewis et al. | 101/454 |
| 5,370,906 | * | 12/1994 | Dankert | 101/457 |
| 5,440,987 | | 8/1995 | Williams et al. | 101/454 |
| 5,443,007 | | 8/1995 | Buenz | 101/480 |
| 5,452,657 | | 9/1995 | Kurtz | 101/487 |

(List continued on next page.)

FOREIGN PATENT DOCUMENTS

| | | | |
|---|---|---|---|
| 2195826 | * | 7/1997 | (CA) . |
| 19612927 | * | 11/1996 | (DE) . |
| 19602289 | | 7/1997 | (DE) . |
| 562952 | * | 9/1993 | (EP) . |
| WO 96/34748 | | 11/1996 | (WO) . |
| WO 97/27065 | | 7/1997 | (WO) . |
| WO 98/53370 | | 11/1998 | (WO) . |

OTHER PUBLICATIONS

Seybold Report on Publishing, vol. 25, No. 11, pp. 1–24, Feb. 1996.*

Seybold Report on Publishing, vol. 25, No. 6, pp. 1–40, Nov. 1995.*

P. Gregory , Chemistry and Technology of Printing and Imaging Systems, Blackie Academic & Professional 1996. Commercial Publication 6 pages.

*Primary Examiner*—Stephen R. Funk
(74) *Attorney, Agent, or Firm*—Eitan, Pearl, Latzer & Cohen-Zedek

(57) ABSTRACT

A printing system which uses a single layer printing member coated on to a cylinder is provided. For waterless offset application, the single layer printing member consists of an oleophobic imaging layer containing an oleophobic resin, coated on an oleophillic cylinder. For wet application, the single layer may either be hydrophilic, coated on a oleophillic cylinder; or vice versa. The single layer printing member is composed of a resin having either oleophobic, hydrophilic or oleophillic properties, to which an infra red absorbing component or components may be added.

39 Claims, 11 Drawing Sheets

U.S. PATENT DOCUMENTS

| | | | | |
|---|---|---|---|---|
| 5,511,477 | | 4/1996 | Adler et al. | 101/401.1 |
| 5,540,150 | | 7/1996 | Lewis et al. | 101/467 |
| 5,595,115 | * | 1/1997 | Rau et al. | 101/142 |
| 5,634,403 | | 6/1997 | Williams et al. | 101/454 |
| 5,636,572 | | 6/1997 | Williams et al. | 101/454 |
| 5,704,291 | * | 1/1998 | Lewis | 101/457 |
| 5,713,287 | | 2/1998 | Gelbart | 101/467 |
| 5,768,995 | | 6/1998 | Miyaguchi et al. | 101/463.1 |
| 5,786,125 | * | 7/1998 | Tsuchiya et al. | 430/303 |
| 5,924,364 | * | 7/1999 | Grabley et al. | 101/467 |
| 5,968,709 | * | 10/1999 | Verschueren et al. | 430/303 |
| 5,976,764 | * | 11/1999 | Bennett et al. | 101/465 |
| 5,984,446 | | 11/1999 | Silverbrook | 347/3 |
| 5,996,499 | * | 12/1999 | Gelbart et al. | 101/467 |
| 6,004,723 | * | 12/1999 | Figov | 430/303 |
| 6,030,712 | * | 2/2000 | Notsu et al. | 430/303 |
| 6,063,528 | | 5/2000 | Morgan | 430/270.1 |

* cited by examiner

41

41

PLATELESS PRINTING SYSTEM

RELATED APPLICATIONS

This application is a Continuation-in Part Application of PCT Application PCT/IL99/00026 filed Jan. 14, 1999, which is based on Israeli Application 122953 filed Jan. 15, 1998, and which are incorporated herein by reference.

FIELD OF THE INVENTION

This present invention relates to offset printing and in particular is directed to a method for plateless printing and to the composition of materials used for this method.

BACKGROUND OF THE INVENTION

There are numerous methods known in the art for producing a master printing plate, on which an image is written and which is then used as a printing plate for the reproduction of multiple copies Examples of such methods are described in "*Chemistry and Technology of Printing and Imaging Systems*", edited by P. Gregory and published by Blackie Academic & Professional in 1996. Typically, the plate contains one or more coating layers applied to a metal or plastic substrate layer.

The cost of producing a plate is relatively expensive and is generally only economical when utilized for printing large numbers of copies. For short printing runs, the cost of the printing plate adds substantially to the cost per printed copy, The plate cost is contributed from two sources:

a. The price of the plate itself b. The price of preparing the plate for printing, i.e. film making, exposure, processing.

Recent developments in offset lithography have led to the use of digitally imaged printing plates whereby information is transferred directly from a computer to the printing plate. Though these printing plates are relatively easily prepared and quickly imaged and processed, their cost is even higher than that of conventional plates, so that they still contribute a significant cost to the printing price.

Another significant contributing cost factor in printing is due to what is commonly termed "make-ready". Make-ready refers to the operational stage involved between producing the last copy of one printing job and the first copy of the next job. Reducing the make-ready time improves the efficiency and allows for better utilization of machine time and increases the capacity of the machine.

Color printing generally involves the separating of the color information into four or more color components each on a separate printing plate and then superimposing the images printed from each plate on top of one another on each piece of substrate. In complex color printing, there are additional problems of lining up images on plates and ensuring that the color balance on the printed copies is correct, which can require more time and thus results in a further increase in the cost per copy.

Another time-consuming stage in conventional ("wet") offset printing is the fine adjustment of the balance of the fountain solution with the ink. This procedure not only is time consuming, but also requires a printer skilled in the art. In addition, the use of fountain solution also causes other problems, such as longer drying times and lower optical density. A waterless printing process for offset printing, which eliminates the use of fountain solution, is described in U.S. Pat. No. 3,511,178 to Curtin, A layer of silicone is used to repel the printing ink instead of the fountain solution.

Printing machines have been developed to minimize the make-ready by imaging directly on press. Infra red imaging has been used for this purpose because it lends itself to digital imaging and can be done under daylight conditions, For instance, the 74 Karat offset printer, manufactured by Karat LP, 3, Hamada Street, Herzelia, Israel, carries such a digitally imaged infra red system of plate production.

Besides the plate cost issue for short runs as mentioned above, the use of a printing plate has other disadvantages. It requires mechanical clamping devices at each end, which produces an unusable area on the plate cylinder as well as requiring the necessity of alignment mechanisms.

Various processes, known in the art, have been introduced for printing which do not require the use of a printing plate. For example, as described in "*Chemistry and Technology of Printing and Imaging Systems*", edited by P. Gregory and published by Blackie Academic & Professional in 1996, a printing process which may be termed "image one—print one" regenerates an image for each print. Ink jet printing whereby a jet of ink directly sprays the image onto the plate where the information is digitally applied from a computer is an example of an "image one—print one" process. This process is not competitive with high quality, color process printing using a printing plate such as offset lithography, because it is relatively slow and has severe substrate limitations.

Xerographic copying is another example of an "image one—print one" process. Disadvantages of this process, which may be considered as an imaging on press process, includes its complexity and the relatively high cost per copy that remains almost constant, irrespective of the number of copies made. Furthermore, this process has a generally inferior quality compared to lithography.

Numerous attempts have been made to produce a re-usable imaging surface for a printing process, examples of which are described in U.S. Pat. Nos. 5,206,102; 5,129,321; 5,188,033; 3,741,118; 4,718,340; 5,333,548 and 5,213,041. Generally, the above-mentioned systems generate a "master" which is then used for conventional wet offset printing.

Reference is now made to FIG. 1, which is a cross-sectional view of a printing member, referenced 300, used in existing conventional digital offset lithographic printing systems. The printing member 300 is formed of at least three layers, A first or substrate layer 310, forms a base or substrate for the printing member 300. A second radiation absorbing layer 312, that carries the image to be printed (once the printing member is imaged by ablation, for example), is over the first layer 310. A third surface coating layer 314 is over the second layer 312. Generally, the imaging layer 312 comprises an infra-red radiation absorbing material, for absorbing infra red radiation to cause ablation. The substrate 310 has an oleophillic surface. The surface coating layer 314 is of a material with an affinity for the ink(s) substantially different to the affinity for the ink(s) of the surface of the substrate 310. Ablation results in de-bonding between the surface coating layer 314 and the substrate 310. On cleaning—either dry or with a liquid—the materials of layers 312 and 314 are Removed in the image areas, revealing the surface of 310.

It would be advantageous to have an offset printing process which does not require a printing plate. Specifically, it would be of further advantage if such a process could be used in a waterless application. Imaging would be on the printing press and preferably, any processing after imaging would be relatively simple. U.S. Pat. Nos. 5,440,987; 5,634,403; and 5,636,572, all to Williams et. al, describe a seamless offset lithographic printing members. The printing members include a hollow cylinder which is attached to the cylinder jacket of an offset printing press. A polymeric coating layer is coated on to the cylinder and a second polymeric surface layer is coated on top of the first layer. While these patents address the problem of the void area needed for clamping plates on a cylinder, their inventions require a cylinder or cylinders to be removed from the printing press and then to receive two or more coatings before returning to press.

U.S. Pat. No. 5,713,287 to D. Gelbart, describes a plateless process at which a solvent-based, polymeric coating layer is deposited on-press on the cylinder. After drying, the imaging converts at least part of the coated layer to have an opposite chemical property to that of the layer.

SUMMARY OF THE INVENTION

The present invention provides a printing system which does not require a printing plate.

It is a further object of the present invention to provide a printing system which uses a single layer printing member coated on to a cylinder. For waterless offset application, the single layer printing member consists of an oleophobic imaging layer containing an oleophobic resin, coated on an oleophillic cylinder. For wet application, the single layer may either be hydrophilic, coated on a oleophillic cylinder; or vice versa.

The single layer printing member is composed of a resin with the required properties (i.e. oleophobic (such a silicone), hydrophilic or oleophillic) to which an infra red absorbing component or components may be added.

There is thus provided in accordance with an embodiment of the present invention, a printing member including an image bearing cylinder having a single imaging layer coated thereon. On selective ablation, polymerization or decomposition of the imaging layer, selective areas of the imaging layer are removed thereby exposing the cylinder. The cylinder and the coated imaging layer are configured to have opposed chemical affinities with regarding to water and/or ink.

Furthermore, in accordance with an embodiment of the invention, the imaging layer includes a mixture including a resin and a cross-linking agent.

Furthermore, in accordance with an embodiment of the invention, the imaging layer also includes carbon black or other infra-red absorbing materials or mixture thereof.

Additionally, in accordance with an embodiment of the invention, the printing member can include components selected from a group consisting of: catalysts, plasticizers, wetting agents, infra-red sensitivity enhancers, dispersion agents, adhesion promoters, polymers and any combinations thereof. Furthermore, in accordance with an embodiment of the invention, the imaging layer after evaporation of solvent, provides a dry layer of thickness having a weight within a range of 1 to 10 grams per square meter.

Additionally, in accordance with an embodiment of the invention, the imaging layer is deposited on the cylinder in the form of a solution. Preferably, the solvent is water and the polymer is either dissolved in the water or held in as an emulsion. Alternatively, in accordance with an embodiment of the invention, the imaging layer may be deposited as a solvent free layer.

Furthermore, in accordance with the invention, the imaging layer is formulated so that it has good release properties together with high scratch resistance, excellent substrate adhesion without the need of providing a pre-coat or primer or other surface treatment (e.g. corona or flame) to obtain such functionality. These requirements assure that after imaging, the whole plate surface could be cleaned without damage (scratch resistance); the background does not accept ink (good release) long run length could be achieved without deterioration (good substrate adhesion) and the process could be repeated after erasing, without multiple coating or surface treatments.

The inventors have found that with their claimed formulations it was possible to achieve all these requirements in one formulation and for many different substrates.

Furthermore, the same requirements of adhesion and scratch resistance are applicable for infra-red digital (waterless) plates, as are used today by direct imaging (DI) offset presses. These formulations can be used for coating a single layer plate, which allows for low cost plates, as opposed to the multi-layer, expensive plates which currently exist.

Furthermore, in accordance with an embodiment of the invention, the cylinder includes material selected from a group consisting of plastics, reinforced plastics, metals, anodized aluminum, ceramics and granite.

In addition, in accordance with an alternative embodiment of the invention, the cylinder is composed of material which is absorbent or reflective to imaging radiation, such as infra-red radiation. Alternatively, only the external surface of the cylinder is absorbent or reflective to the imaging radiation. Furthermore, it is an object of this invention to provide an infra-red ablatable waterless printing plate with one coat only which contains a silicone resin and an infra-red absorbing material.

There is further provided, in accordance with an embodiment of the invention, a printing member including an oleophobic single coating imaging layer containing a silicone polymer and an infra red absorbing material, and an oleophillic substrate underlying the imaging layer. On selective ablation of the imaging layer, selective areas of the imaging layer are removed thereby exposing the substrate.

In addition, there is further provided, in accordance with an embodiment of the invention, a printing member including a cylinder, an image bearing substrate attached to said cylinder; and a single imaging layer coated on said substrate on press. On selective ablation, polymerization or decomposition of said imaging layer, selective areas of the imaging layer are removed thereby exposing the cylinder. The substrate and coated imaging layer are configured to have opposed chemical affinities with regarding to water and/or ink.

Furthermore, in accordance with an embodiment of the invention, the substrate is a material selected from a group consisting of anodized aluminum, polyimide or polyester. Further, the substrate may be inflexible and in the form of a machined cylinder. Alternatively, the substrate may be the surface of the cylinder. The substrate may be a material selected from a group consisting of metals, reinforced plastic, ceramic and granite, The cylinder may be seamless.

Additionally, there is provided, in accordance with an embodiment of the invention, a printing system which includes the printing member of the invention, an imaging system for placing an image on the image bearing cylinder and an inking assembly for applying ink to the imaged printing member.

The printing system may also include, for wet offset application, a dampening system for applying the fountain solution to the imaged printing member; alternatively, a single fluid of emulsified water in ink may be applied by the ink system alone.

Furthermore, in accordance with an embodiment of the invention, the system further includes means for preparing the imaging layer, means for coating the imaging layer on to the cylinder and means for drying, solidifying and cross-linking the imaging layer. The preparing means includes means for mixing at least two components together, one of the components being a film former for coating the imaging layer on to the cylinder.

The system further includes means for cooling the coated cylinder after the drying/curing stage and/or during the printing stage and means to protect the imaging system from any heat that may evolve at this stage.

The system may also include means for washing the mixing and coating systems.

In addition, in accordance with an embodiment of the invention, the system also includes at least one impression cylinder and a blanket cylinder disposed between the print cylinder and at least one impression cylinder, so that the system operates as an offset system.

Furthermore, in accordance with an embodiment of the invention, the system further includes at least one impression cylinder and a control system for activating the imaging system to place an image on the image bearing cylinder and for controlling the application of ink or an ink and water emulsion onto the imaged printing member, so that the system operates as a computer to press printing system The computer to press printing system includes a rotary digital offset press (DOP) printing system. Additionally, for wet offset application, a dampening system may be included.

Furthermore, in accordance with an embodiment of the invention, the system further includes means for cleaning the imaged printing member and means for removing the imaging layer.

Additionally, there is provided, in accordance with an embodiment of the invention, a method of preparing a printing member having a single imaging layer. The method includes the steps of:

a) providing a cylinder having an affinity for ink;

b) preparing a mixture including in ink adhesive polymer, a cross linking agent an infra-red absorbent agent and other appropriate ingredients to form an imaging layer;

c) coating the prepared mixture on to the cylinder; and d) solidifying the prepared mixture.

Alternatively, the cylinder may be hydrophilic, in which case the mixture for coating the imaging layer consists of an oleophillic polymer, a cross linking agent and an infra-red absorbent agent; or alternatively the cylinder may be oleophillic, in which case the mixture for coating the imaging layer consists of a hydrophilic polymer, a cross linking agent and an infra-red absorbent agent.

Finally, there is also provided, in accordance with an embodiment of the invention, a method of imaging the printing member of the invention. The method includes the steps of:

a) providing a printing member which includes a cylinder having an affinity for ink and an oleophobic imaging layer coated on the cylinder; or providing a printing member which includes a cylinder having an affinity for ink and a hydrophilic imaging layer coated on the cylinder; or providing a printing member which includes a cylinder having an affinity for water and an oleophillic imaging layer coated on the cylinder; and b) placing an image on the printing member.

Furthermore, in accordance with an embodiment of the invention, the step of providing includes the steps of:

preparing a mixture including the appropriate polymer and a cross linking agent;

coating the prepared mixture on to the cylinder; and solidifying the prepared mixture.

The prepared mixture includes solvents and the method further includes the step of evaporating any solvent on the surface of the mixture. Preferably, the mixture is a water-based solution or an emulsion, and the method involves the step of evaporating the water from the coated wet layer.

In a further embodiment, the mixture is solventless, in which case, an evaporation stage is not required.

In addition, in accordance with an embodiment of the invention, the method optionally includes the step of cleaning the image after the step of placing an image and also optionally includes the step of hardening the image areas or the background to the image areas. The step of printing an image includes the steps of applying an ink to the cylinder and cooling the cylinder.

Furthermore, in accordance with an embodiment of the invention, the method includes a step of cooling the cylinder and a step of placing an image by selectively ablating the printing member with radiation that is absorbable by the printing member.

Alternatively, the step of placing an image includes the step of breaking the chemical bonds of the coated imaging layer into smaller molecules or the step of polymerizing the imaging layer.

Finally, there is provided, in accordance with an embodiment of the invention, a computer to plate system which includes means for re-constituting a single layer plate on an existing substrate, an imaging system for placing an image on the image bearing substrate and means for cleaning the imaged plate.

The re-constituting means includes erasing means for removal of the used imaged coating from a previous job, mixture means for preparing a mixture, coating means for coating the prepared mixture on the erased substrate, and solidifying means for solidifying and curing the coated layer.

The coated layer is an infrared absorbing layer, having a chemical affinity with regards to water and/or ink opposite to that of the substrate.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 2:
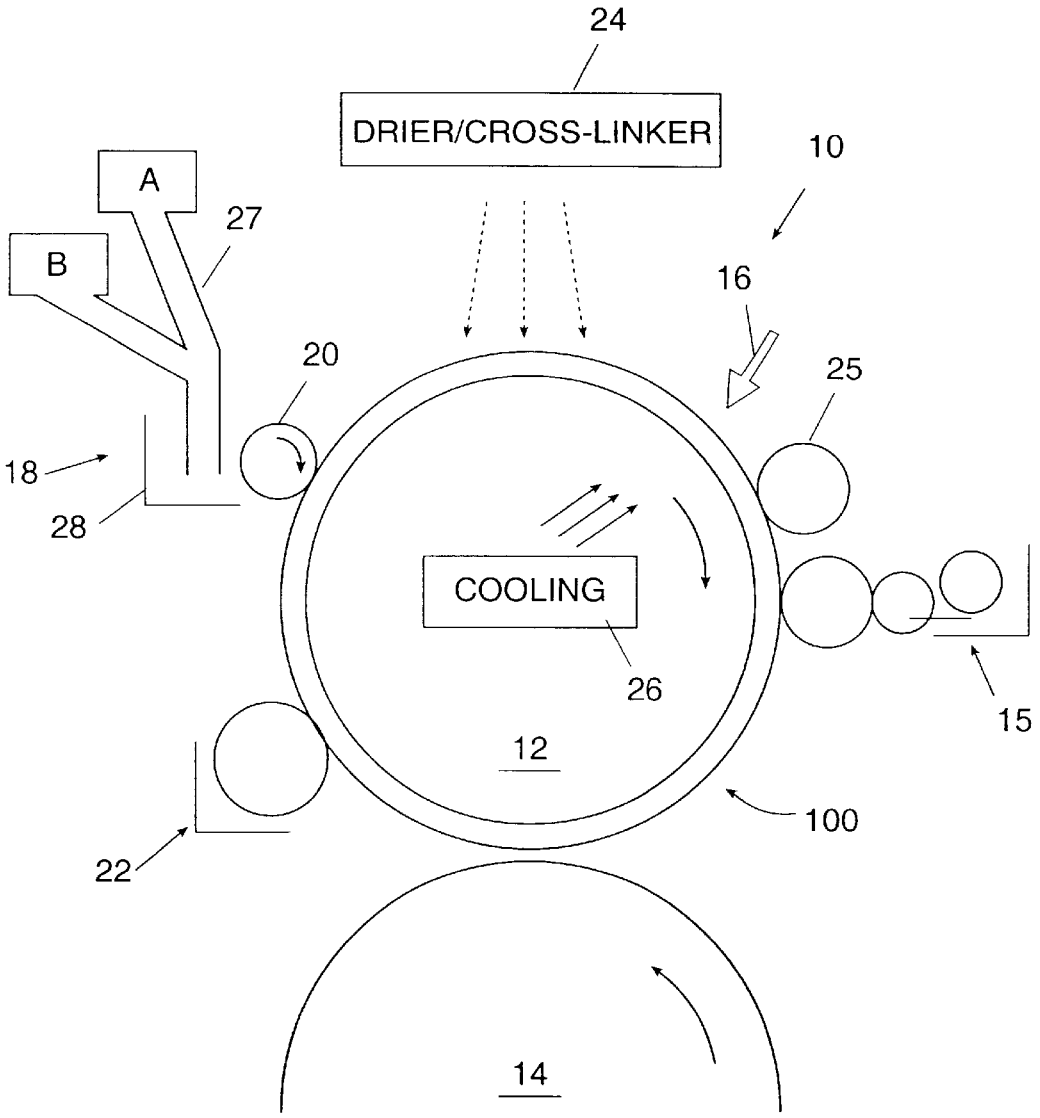
FIG. 2 is a schematic illustration of a plateless printing system, constructed and operative in accordance with a preferred embodiment of the present.
Figure 3:
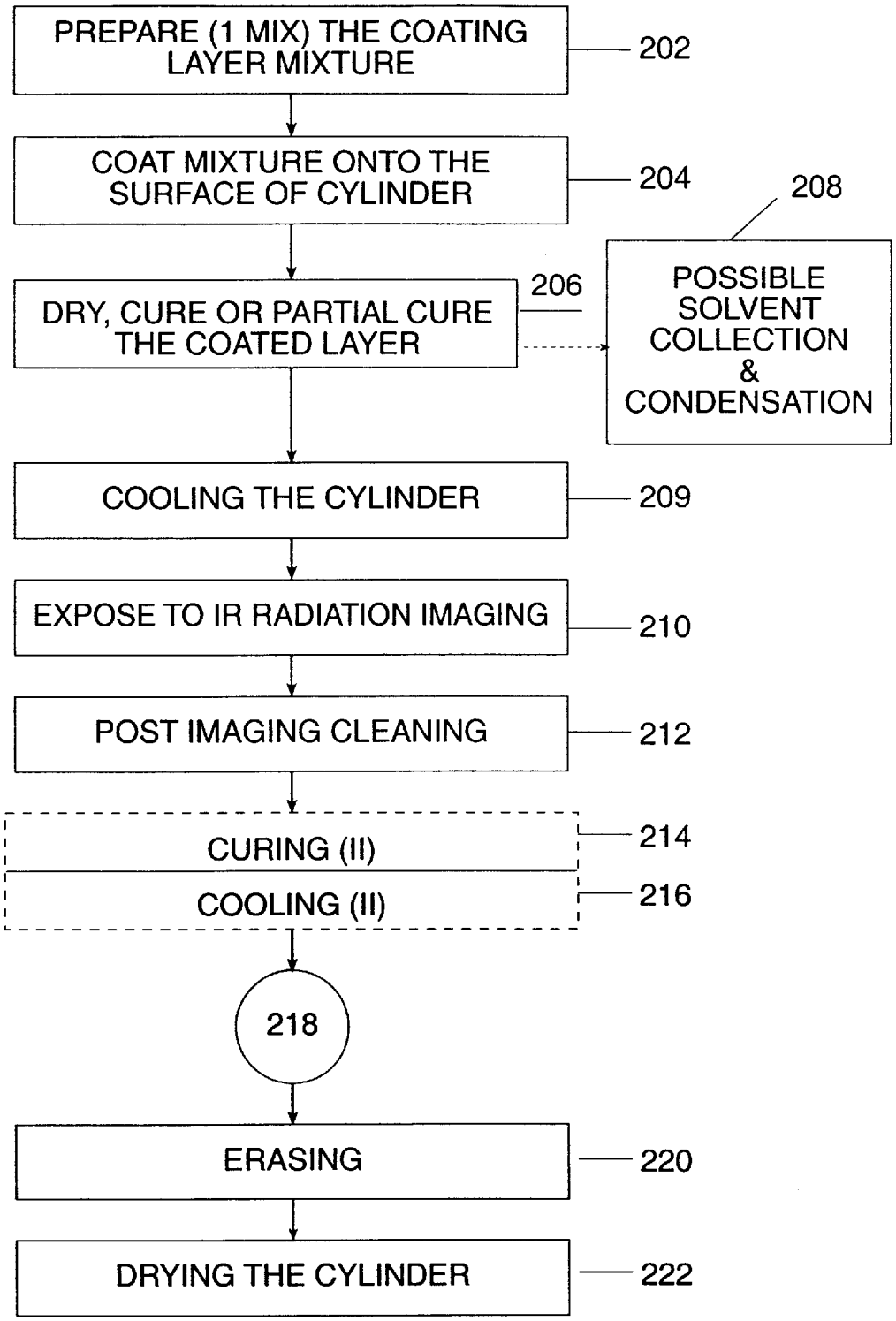
FIG. 3 is a high level flow chart illustration of the operation of the plateless printing system of FIG. 2.

Reference is now made to FIGS. 2 and 3. FIG. 2 is a schematic illustration of a plateless printing system, constructed and operative in accordance with a preferred embodiment of the present invention, and FIG. 3, is a high level flow chart illustration of the operation of the plateless printing system.

The 'plateless' printing system 10 preferably comprises an image bearing cylinder 12, a blanket cylinder 14, a printing (or inking) system 15 and an imaging system 16.

It is a particular feature of the present invention that, in contrast to existing printing systems which carry printing plates, such as waterless IR ablatable printing members, an image bearing cylinder 12 does not carry a printing plate. Instead, an image bearing cylinder 12 has an imaging layer, generally designated 100, directly coated onto the cylinder 12, thereby creating a 'plateless' printing member, as described in detail hereinbelow.

In an alternative version of the embodiment, the cylinder may carry a replaceable substrate, either as a sleeve or as a sheet, that can be replaced after a large number of jobs. This has the advantage of protecting the cylinder from wear.

The 'plateless' printing system 10 preferably also comprises a mixing system 18 for preparing the imaging layer 100, a coating head 20 for applying the imaging layer 100, a plate cleaning system 25 for post-imaging cleaning, an erasing system 22 and a drier/cross linker 24. In addition, the 'plateless' printing system 10 also comprises a cooling system 26 for use after the heating stage and during printing.

Mixing system 18 comprises apparatus to mix at least two components, generally referenced A and B, which are discharged via a pipe system 27, or similar, into a mixing container 28 where components A and B are mixed together to form the coating mixture which is then coated onto cylinder 12 to form an imaging layer 100. An automatic washing system may be added to clean the mixing and coating system on press in case of a short pot-life of the mixture. Including the mixing (and washing if necessary) stages into the process, makes it possible to use mixtures that have short-pot life or shelf-life (such as a polymer and its cross-linker).

The cylinder 12 is preferably an oleophillic surface and may comprise any material which is suitable for receiving and adhesion of the oleophobic coating layer 100. Non-limiting examples of suitable surfaces include plastics, reinforced plastics, metals such as aluminum (or anodized aluminum) and copper, ceramics and stones, such as granite. Thus, in contrast to conventional plate processes, the surface of cylinder 12 which acts as a substrate, may be of a non-pliable material that may or may not be formable into a sheet.

For a wet offset application, the cylinder may be hydrophilic, where the coating layer is oleophillic, or vice versa.

The cylinder 12 may be entirely composed of an infra-red absorbent material or, alternatively, only the external surface of the cylinder is composed of a solid infra-red absorbent material. Since, in both these two alternative embodiments, the surface of cylinder 12 (that is, the underside of the oleophobic layer 100) is infra-red absorbent, the coating layer 100, which is coated on the cylinder 12, need not itself be infra-red absorbent, but may be transparent.

Alternatively, the outer surface of the cylinder or the cylinder itself may be composed of an IR reflecting material, to enhance the sensitivity of the imaging layer; in this case, the coated layer should be IR absorbent.

Figure 1:
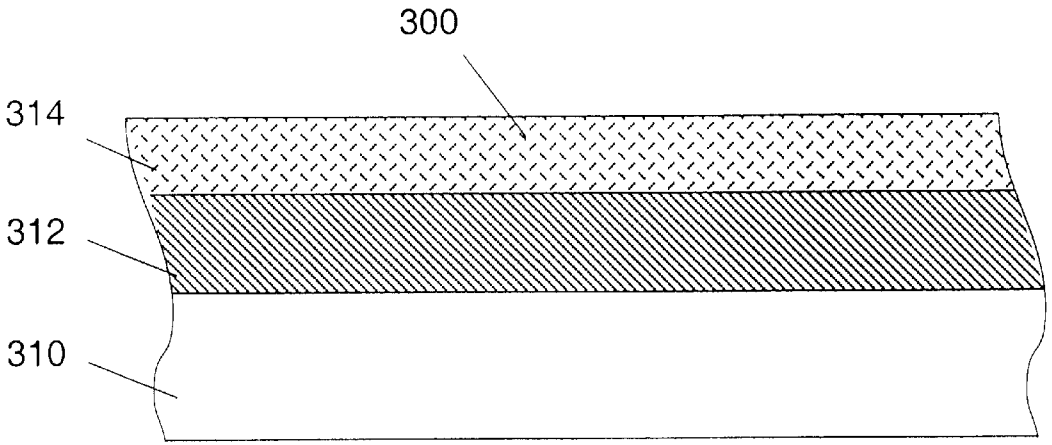
FIG. 1 PRIOR ART
FIG. 1 is a cross-sectional view of a prior art printing member.

By coating an imaging layer 100 on to a base with opposite ink or water accepting properties (cylinder 12), a single layer printing member is created. This is in contrast to existing printing members, described hereinabove with respect to FIG. 1, which generally comprise a substrate base layer on which at least two layers are coated.

Preferably, the A and B components of the coating layer 100 for waterless offset application comprise a film former such as polysiloxane, or other oleophobic polymeric material (compound A) and a separated component, such as a compound of platinum or tin, for example, as a catalyst and/or cross linker (compound B).

The coating layer 100 may be either solventless or may have been deposited from solvents. Preferably, water is utilized as the solvent because of environmental and health and safety considerations. In this case the resin may be held in the form of an emulsion or as a dissolved substance.

Preferably, components A and/or B should incorporate an infrared (IR) absorbing component, such as carbon black or nigrosine. The mixture 100 may also contain wetting agents, adhesion promoters and polymers to enhance the coating and bonding properties of the mixtures.

It has been found that when using water based silicone emulsions, in order to obtain good wetting for a variety of substrates together with good adhesion to said substrates and good release properties of the film formed and good scratch resistance, the following components must be present in the following parts by weight;

| | | |
|---|---|---|
| a) | Polysiloxane emulsion (percentage solids includes surfactants used during manufacture) | 40% to 80% |
| b) | Silicone catalyst (solids content) | 0.01 to 3% |
| c) | Silicone crosslinking agent (percentage solids) | 5–15% |
| d) | Water soluble crosslinkable amine resin | 4%–25% |
| e) | Catalyst for amine resin | 0.5% to 5% |
| f) | Added surfactant | 0.5%–10% |
| g) | Infrared absorbed | 3%–40% |
| h) | The remaining material is water | |

Examples of suitable polysiloxane water-based emulsions are as follows, (each material is supplied with suitable catalysts and crosslinking agent):

| Polysiloxane Water-Based Emulsions | Catalysts/Crosslinking Agents |
|---|---|
| Dehesive 410E (50% solids including a platinum catalyst) | Crosslinker V72 (35% solids) |
| Dehesive 38197 VP (50% aqueous emulsion addition cross-linkable) | Crosslinker V72 (35% solids) |
| SYL-OFF ™ 7920 silicone emulsion | SYL-OFF ™ 7922 catalyst emulsion |
| Silcolease E70888, 70840 | Catalyst 70889S or 71823 |
| Silcolease 71841 | Catalyst 71842 or 71823 |
| Silcolease 71822 | Catalyst 71823 |
| Silcolease E 70840 | Catalyst 70827A |

Dehesive and Crosslinker products are manufactured by Wacker Chemie GmbH, Munich, Germany). Silcolease products are manufactured by Rhone-Poulenc Silicones UK, Surrey, England. SYL-OFF emulsion products are manufactured by Dow Corning Europe, La Hulpe, Brussels, Belgium.

Examples of suitable crosslinkable water soluble amine resins are as follows:

a) Cymels 350, 323,327,328,373,385, 1171, 1172 (manufactured by Dyno-Cytec);

b) Dynomins UM-15 (manufactured by Dyno-Cytec); and c) BE 312 Beetle Resin (manufactured by BIP Limited, Oldbury, West Midlands, UK.

It has been found that although catalysts for the cross-linking resins may be sulphonic and carboxylic acids, amine blocked acids are most suitable.

An example of one preferred mixture for a waterless offset application is a mixture based on water emulsions of silicones such as the commercially available SYL-OFF™ 7920 emulsion coating and SYL-OFF™ 7922 catalyst manufactured by Dow Corning Europe, La Halpe, Brussels, Belgium.

Sufficient material to be formed into the equivalent of a plate is mixed together in the mixing container 28 and coated onto the surface of the 'plateless' cylinder 12. Depending on the pot life of the mixture, a washing stage of the mixing and coating system may be applied after each mixing. Even though cylinder 12 does not carry a plate, as would be the case in conventional plate cylinder systems, the coating layer 100 (or "plateless" plate) carries out the functions of the conventional digital plate.

The imaging layer 100 is coated on to the cylinder 12 using the coating head 20 with a dye slot, for example. After solvent evaporation or cross-linking, the dry coating thickness may be expressed as a weight of from 1 to 5 grams per square meter. Alternatively, a metered rod or any other application system known in the art may be used as the coating head 20.

The drier/cross linking station 24 may function in varying ways. In the embodiments where the coating 100 is polymerized or cross-linked before imaging, it would be used to evaporate off any solvent present after initial coating and then possibly to cure the polymerized image areas after non-polymerized material is removed by washing. In the embodiments where the image area is to be destroyed during imaging, the drier/cross linker will evaporate any solvent present after coating and would then cross-link or polymerize either before imaging or after imaging/cleaning to harden and insolubilize the background areas. Alternatively station 24 may comprise a heating unit such as a radiant heater or an ultra-violet (UV) drier. The heating/curing stage may also be obtained by a heated electrical blanket below the upper surface of the cylinder, or by hot air, by combination of means or by any other suitable heating/curing means. With high power imaging unit, it may be used to cure the IR absorbing coating layer as well.

Imaging system 16 comprises one or more infra red lasers which have been modulated to radiate energy corresponding to a digital image. Such a suitable system is described in PCT Patent Application PCT/IL97/00528 (Publication No. WO 97/27065) to the present Applicant, incorporated herein by reference.

Infra-red imaging of the system may occur in various ways, as follows:

Imaging may occur due to ablation where destruction of material occurs. In contrast to systems where the underlayer contains the infra red absorbing material, in the present invention the infra red absorbing material is preferably contained in the overlayer, or alternatively in both the overlayer and the underlying cylinder. Waterless plates imaged by debonding ablative mechanisms have been found to be difficult to automatically clean in the post image stage. The debonded oleophobic rubber, such as polysiloxanes which are commonly used, maintains its elastomeric form and gathers into large solid deposits that clog the cleaning system as well as the press when imaging on press. It has been found that where the infra-red material is in the oleophobic layer itself, the layer is thermally degraded where ablation occurs and the oleophobic resin loses its elastomeric properties and this facilitates automatic cleaning. Where ablation occurs, the decomposed areas of oleophobic coating layer 100 must be removed by dry or wet cleaning so that the exposed areas of the cylinder 12 provide the oleophillic areas during printing.

It is possible that layer 100, while free of solvent before imaging, may remain in an unpolymerized state to facilitate ablation. This may be in a liquid or a semi-solid form in contrast to conventional plates which have to be packed and handled before use and thus, conventional plates cannot have a wet surface.

Another possibility is that the heat generated by the thermal imaging process will break the chemical bonds of the polymer and that the resulting smaller molecules will then become less chemically or mechanically resistant than the original layer and then can be cleaned away as part of a post imaging treatment.

A further possibility is that the heat generated during imaging is used to polymerize the coating layer 100 and the unpolymerized coating is subsequently removed by washing it away.

The cleaning system 25 comprises any suitable dry or solvent cleaning process. The cleaning element can consist of a brush, rubber roller or other similar element. Preferably, a vacuum suction is applied together with the cleaning element in order to remove the debris from the press. A liquid may be used together with the rubbing action of the cleaning element to assist in removing any loose particles (if the ablation process is involved) or pre-polymeric material from the background or image areas with decomposed material. If a liquid or solvent is used, a further rotation of the cylinder 12 without contact with any liquid may be made so as to ensure that the surface is dry.

The solvent erasing system 22 is used to remove the inked up image after the printing impressions have been made. Cleaning may be any suitable process such as abrasion or by means of a solvent to aid loosening of the resin layer (layer 100) or by a combination of both methods. A suitable solvent may be a regular blanket wash.

A corona treatment to decompose the layer and/or a vacuum suction to remove the loosened material may be used as well.

The printing (or inking) system 15 is any suitable inking system known in the art, for applying ink to "plate" cylinders.

Cooling system 26, which is placed within the image bearing cylinder 12, controls the temperature of the cylinder to cool it after the heating stage and during printing to avoid toning that can occur with waterless inks and to support printing stability.

Offset printing is carried out by means of blanket cylinder 14 on to a printing substrate conveyed by an impression cylinder (not shown). Impressions are taken, usually onto paper, but any required substrate may be printed.

Reference is now made to the flow chart of FIG. 3 to illustrate the plateless printing system.

The imaging layer mixture is prepared in mixing system 18 (step 202) by mixing at least two components comprising a film former and a separated component together.

The mixture is then coated onto the surface of the 'plateless' cylinder 12 (step 204), using a suitable coating head 20. Such a coating head should preferably be easy to wash and not sensitive to the distance of the coating head to the cylinder, for instance a dye slot coater.

Depending on the pot life of the mixture, a washing stage of the mixing and coating system may be applied as necessary.

After the application of the mixture 100 (step 204), the drier/cross linker 24 is used either for drying (i.e. to evaporate any solvent on the printing cylinder 12, which may be collected and condensed (step 208)), and/or for partial curing and/or for full curing (step 206).

After stage 206 during which the cylinder is heated and prior to imaging, the image bearing cylinder is cooled (step 209), in order to avoid dimensional changes of the substrate between the imaging step and the printing step. The imaging layer 100 is then selectively exposed by the imaging system 16 during multiple rotation of the cylinder (step 210).

During further rotation of the cylinder, post-imaging cleaning system is operated (step 212). Depending on the embodiment, cleaning either removes ablated debris, or removes unpolymerized resin from the background or washes out decomposed material from the image areas. If a liquid cleaner is used, surplus solvent is removed.

After the cleaning process (step 212) is completed, the dryer/cross linker may be (optionally) re-operated to further harden background or image areas to give optimum robustness and adhesion to the cylinder needed for the printing part of the cycle (Step 214). This second stage of heating is followed by a second cooling of the cylinder (Step 216).

The operational parameters of the dryer/cross linker could in principle be regulated separately for each job in order to optimize the make ready time (as curing time may influence sensitivity and hence imaging time, as well as erasing time) versus required run length (as curing will influence the coating resistance).

The image bearing cylinder surface is now ready to print (step 218) and the appropriate offset ink (either waterless or "wet") is applied by the printing (or inking) system 15 to the cylinder. The image bearing cylinder is cooled (if necessary) to control the temperature of the ink during printing.

The offset printing process takes place via blanket cylinder 14 by taking a plurality of impressions, usually onto paper, but any required substrate may be used for printing.

Figure 5:
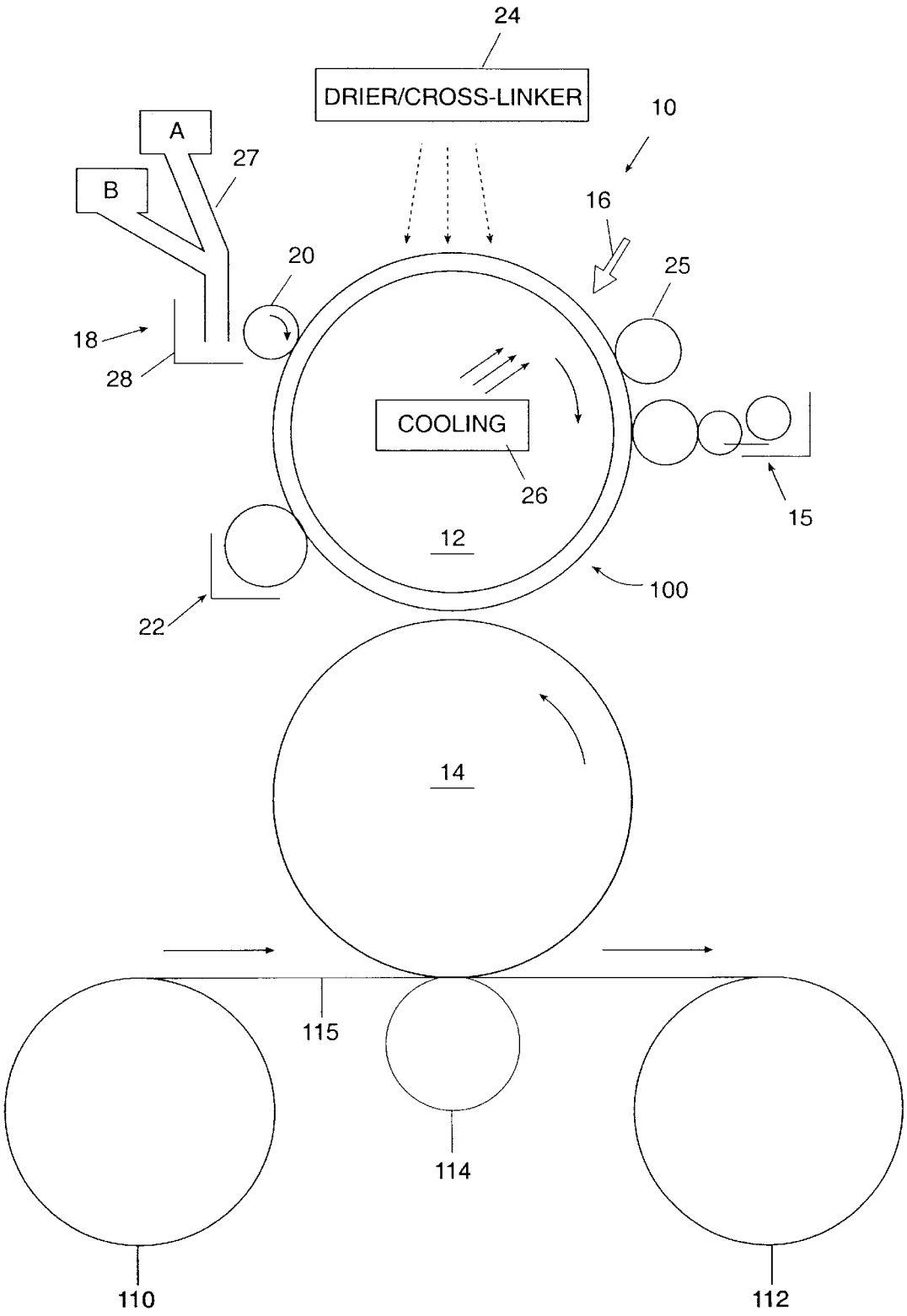
FIG. 5 illustrates the web offset application of the plateless process.

The substrate to be printed can be in the form of sheets, or in the form of a web. Reference is now made to FIG. 5 which illustrates a web-offset printing system. FIG. 5 is similar to FIG. 1 with the addition of a substrate unwind 110 and a substrate rewind 112. The roll of substrate 115 is fed via an impression roller 114 to receive the print from the blanket cylinder 14 and then re-wound onto roll 112. Alternatively, sheets can be printed.

The application of this technology for a web offset printing has the following advantage: as the plate cylinder can be made seamless, it can carry a continuous image, uninterrupted by the need for clamps which are generally required in order to hold the plates.

After the required number of impressions have been printed, the remaining resin layer (mixture 100) plus the inked up image is removed (step 220) by the solvent plate erasing system 22. Cleaning may be any suitable process such as abrasion or by solvent aided loosening or a combination of both. In special conditions, a corona treatment may be used as a facilitator. If required, the cylinder 12 is then dried (step 222). The cylinder 12 is then ready for the application of the mixture, as previously described and the process (steps 202–222) can be repeated.

It will be appreciated by persons knowledgeable in the art that the present invention is also applicable to existing computer to press printing machines which can be adapted to be used with a 'plateless' printing member. A typical computer to press printing machine is described in PCT Patent Application PCT/US96/06207 (Publication No. WO 96/34748) to the present Applicant.

It will also be appreciated that such coating material as herein described can be used in the manufacture of a one layer infra red imageable offset printing plate. This could be useful for existing presses which can not be modified for the plateless process. A single layer plate will still be cheaper than existing plates as coating multiple layers increase dramatically the cost of the plate.

Another possible application of this invention would be to make a plate-setter which will be used for implementing the whole plateless process for recycling the plates. Such a plate-setter will be fed with the used plates, erase them, coat, dry, image and clean; the ready plates will be fed into the press. Once done their job, the plates will be re-fed into the platesetter and used again. This will have advantages of reducing plate costs as well as elimination of used aluminum aggregation.

Reference is now made to FIGS. 4*a*–4*g* which illustrates the image carrying cylinder during the plateless printing sequence.

Figure 4A:
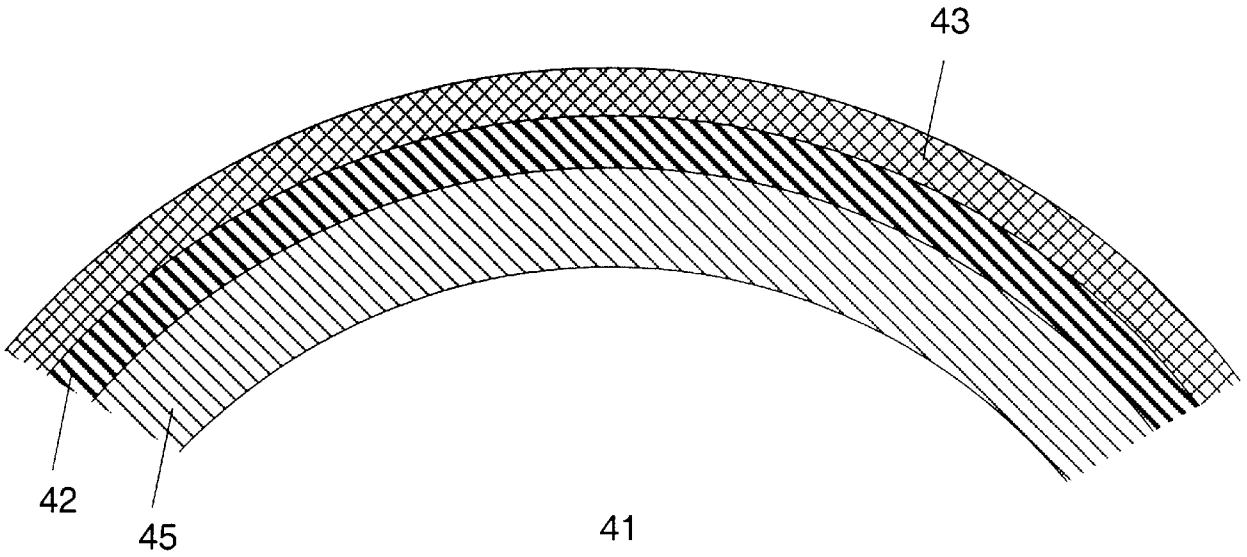
FIGS. 4*a*–4*g* illustrate the image-carrying cylinder during the various stages of plateless printing.

FIGS. 4*a*–4*g* are partial sectional elevations of image bearing cylinder 12 (FIG. 2). FIG. 4*a* shows the cylinder before any coating is applied. The cylinder may be comprised of a single material. Alternatively it may consist of any or all the following components:

1. An internal cooling system (41)
2. A hollow cylinder (45)
3. Under-surface electrical heating elements (42)
4. A sleeve or a sheet top surface, which may be replaceable (43)

The entire cylinder or only the top (43) may be either IR absorbing or IR reflecting.

Figure 4B:
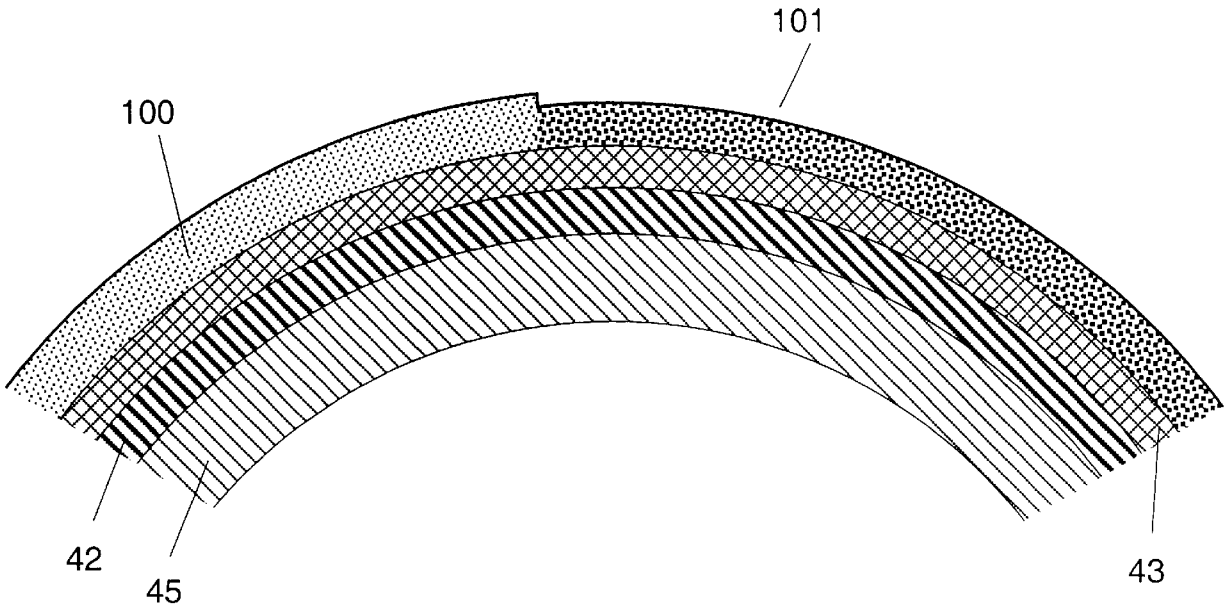

FIG. 4*b* shows the cylinder after the coating (100) is applied, dried and (possibly) cured (101). The coating, after drying (and optionally curing) is shown in the right hand side (reference 101).

Figure 4C:
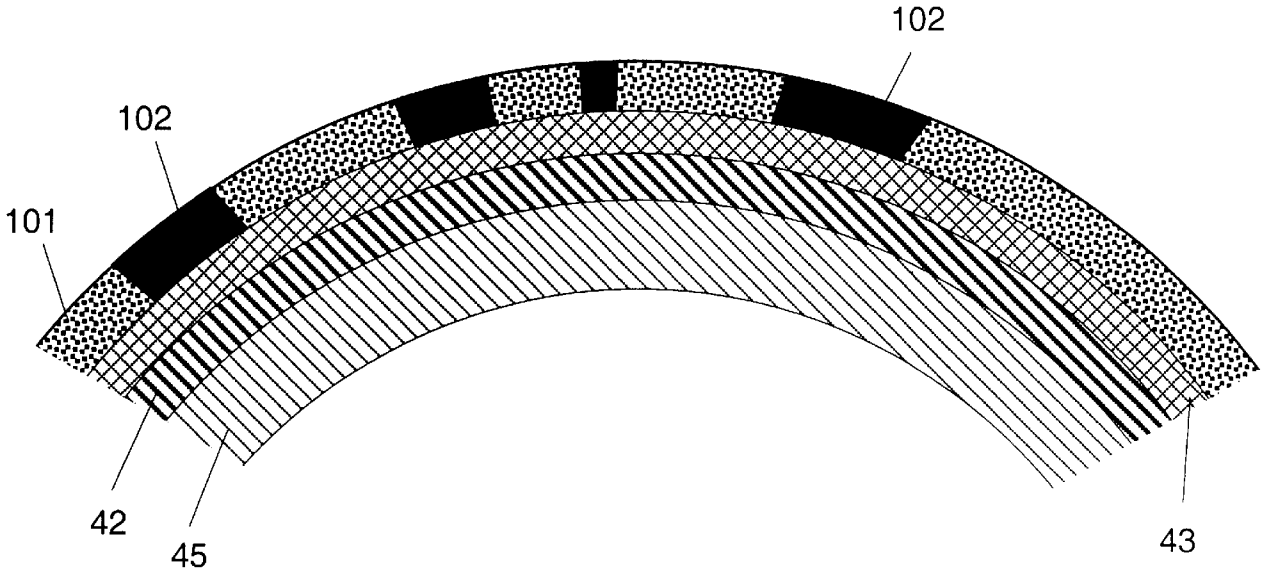

FIG. 4*c* illustrates the coating layer after imaging has taken place. In this case, the imaging ablates or decomposes the imaging area (102).

Figure 4D:
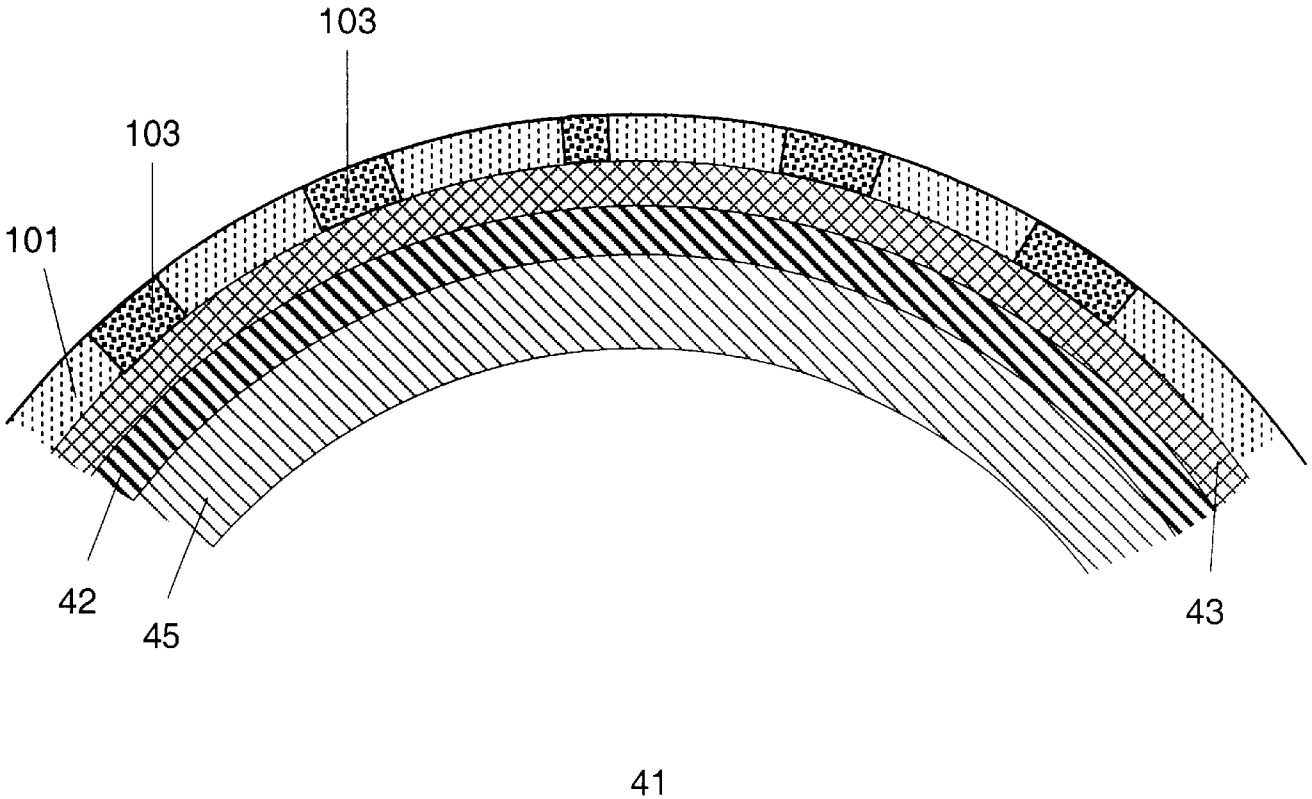
Figure 4E:
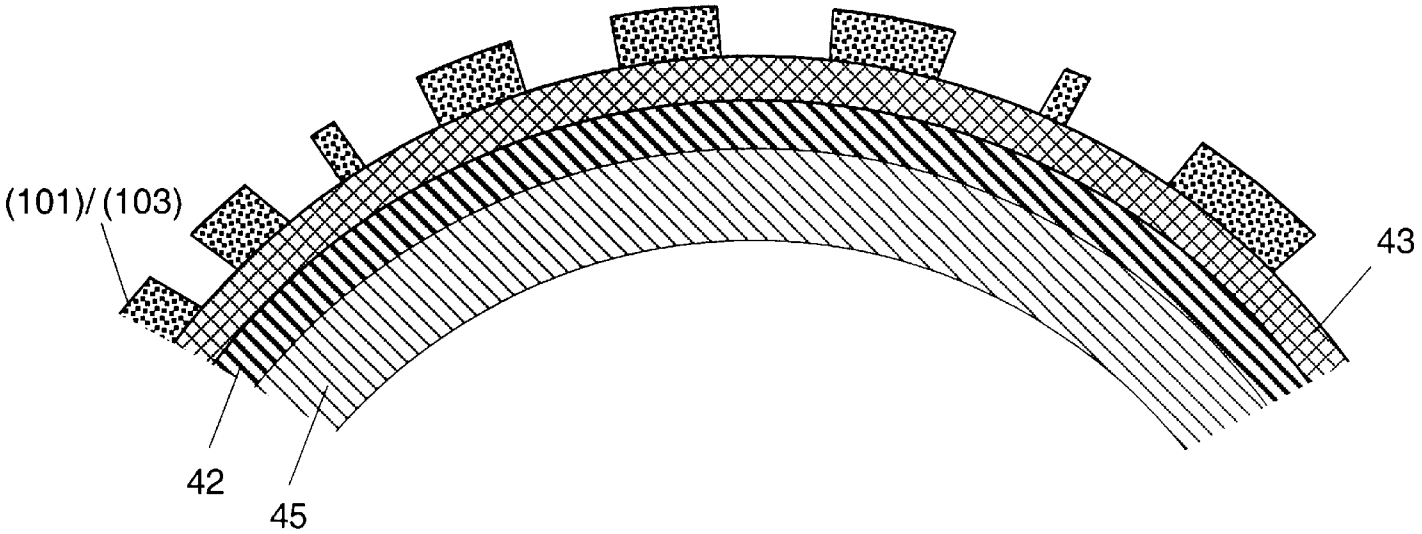
Figure 4F:
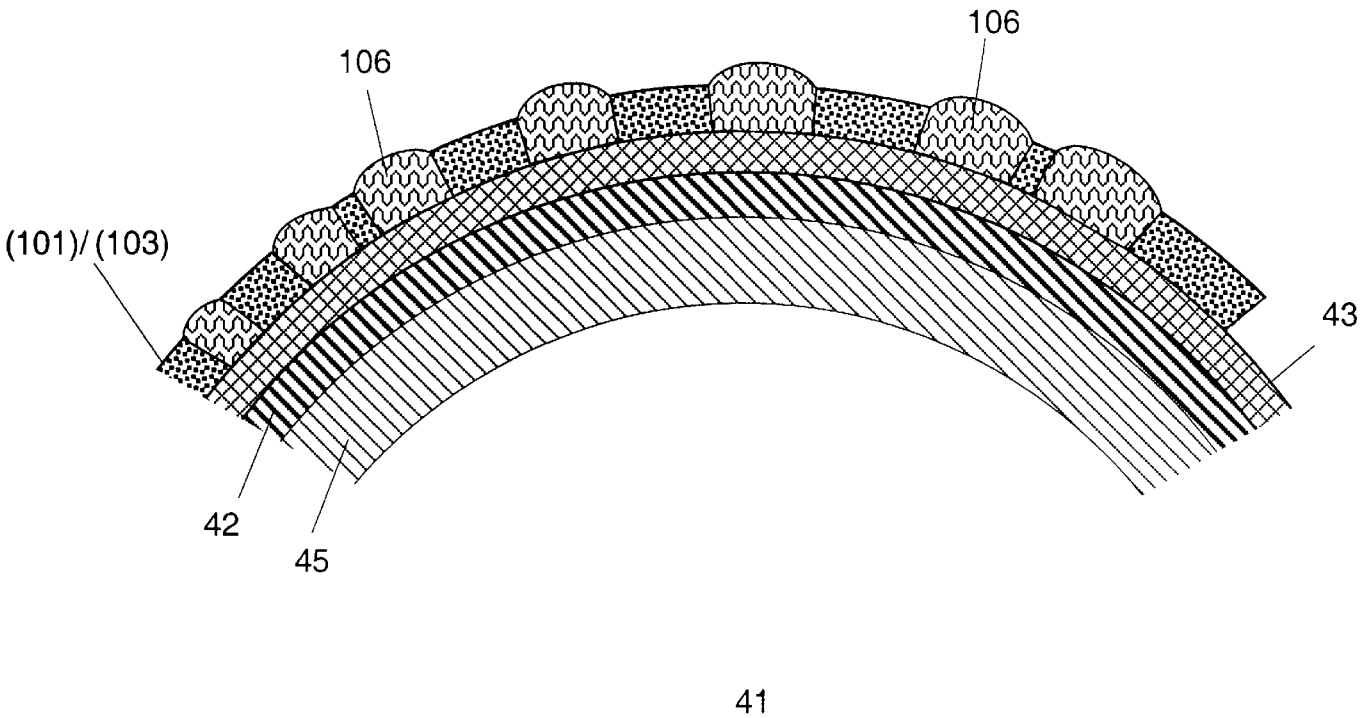
Figure 4G:
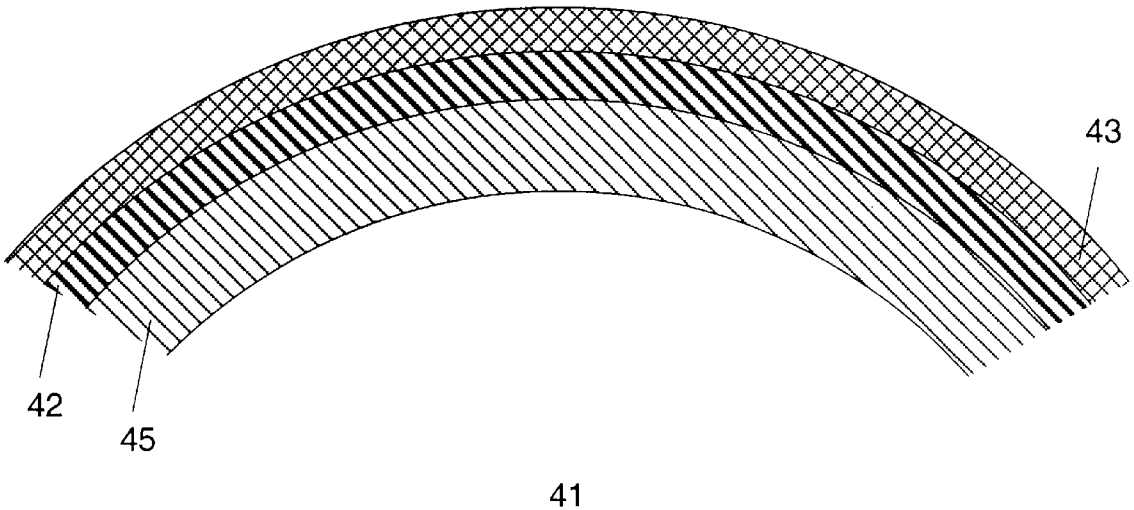

FIG. 4*d* illustrates the case where imaging cures the background area (reference 103).

FIG. 4-*e* shows the cylinder after post-imaging cleaning has taken place. After cleaning (whether the imaged area or non-imaged area has been removed), the cured layer is left on the cylinder on the background area (103). The cylinder surface area functions as the ink accepting layer (43).

FIG. 4-*f* shows the cylinder after ink (106) is applied during the printing cycle.

FIG. 4-*g* shows the cylinder after the erasing stage, fully cleaned, ready for the next job (that is as FIG. 4*a*).

EXAMPLE I

Waterless

The following formulation was prepared as a mixture (all numbers designating parts in the formulation are in parts by weight of the entire formulation);

| | |
|---|---|
| Distilled Water | 10 parts |
| 2-Butoxy Ethanol | 0.86 parts |
| Water Soluble Nigrosine | 1.3 parts |
| Cymel 373 | 1.24 parts |
| BYK 345 | 0.6 parts |

-continued

| | |
|---|---|
| SYL-OFF ™ 7920 | 10 parts |
| SYL-OFF ™ 7922 | 2 parts |

The mixture was applied to a 175 micron polyester film to a wet thickness of 12 grams per square meter and then dried for four minutes at 140° C. The layer was then imaged with the infra red imaging system described in PCT Patent Application PCT/IL97/00528 (Publication No. WO 97/27065) to the present Applicant, using an imaging intensity necessary for material with a sensitivity of 800 millijoules per square centimeter. The image was gently cleaned with water and mounted on a GTO printing press running with a waterless printing ink. After 5000 impressions, the plate surface was rubbed vigorously with a damp abrasive cloth, damped with aqueous alcohol, removing both the inked image and the silicone based background so that only the polyester surface was left. The polyester was removed from the printing machine and re-coated as previously described and the entire cycle repeated.

EXAMPLE II

Waterless

The following formulation was prepared as a mixture (all numbers designating parts in the formulation are in parts by weight of the entire formulation)

| | |
|---|---|
| Dehesive 410E (Wacker Chemie GmbH, Munich, Germany) | 135 parts |
| CAB-O-JET 200 (Cabot Corporation, Billerca, Massachusetts, US) | 58 |
| Q2-5211 Super wetting agent (Dow Corporation, Midland, MI, USA) | 6 |
| Cymel 373 (Dync-Cytec) | 21 |
| Cycat 4045 (amine blocked p-toluene sulphonic acid, (Dyno-Cytec | 5.7 |
| Crosslinker V72 (Wacker) | 25 |

The complete mixture was then bar coated onto a grained anodized aluminum plate surface and dried at 140° C. for four minutes to a dry coating weight of 2.7 grams per square cm.

The layer was then imaged as in Example I. After imaging, the surface was wiped with a dry cloth to remove ablated material and mounted on a GTO printing press. 5000 impressions were made and then the plate was rubbed vigorously with an abrasive cloth to erase all of the coating so that the cleaned aluminum surface could be re-coated. Imaging and printing was repeated and again 5000 impressions were obtained.

It will be appreciated that this experiment signifies that the mixture can be the coating layer 100, coated onto an anodized aluminum plateless cylinder 12 and dried, cured, imaged, printed, erased, re-coated etc., on the apparatus as shown in FIG. 2 as previously described.

It will be further appreciated that the present invention is not limited by what has been described hereinabove and that numerous modifications, all of which fall within the scope of the present invention, exist. Rather the scope of the invention is defined by the claims which follow:

What is claimed is:

1. A computer to plate system comprising:

a. means for re-constituting a single layer plate on a substrate, said re-constituting means comprising:

i. erasing means for removal of a used imaged coating from a previous job to generate an erased substrate;

ii. mixture means for preparing a mixture;

iii. coating means for coating said prepared mixture on said erased substrate; and iv. solidifying means for solidifying and curing said coated layer;

whereas said coated layer is an infrared absorbing layer, and one of said coated layer and said erased substrate is oleophilic and the other is oleophobic;

b. an imaging system for placing an image on said coated layer; and c. means for cleaning said imaged plate;

wherein said coated layer is formed from a mixture including a water soluble crosslinkable amine resin and its catalyst, a silicone emulsion and its crosslinking agent and catalyst, a surface active agent, and an infra-red absorbing agent.

2. The system according to claim 1, wherein said mixture includes 40% to 80% (percentage solids) of silicone emulsion.

3. The system according to claim 2, wherein said mixture includes 0.01% to 3% (percentage solids) of silicone catalyst.

4. The system according to claim 3, wherein said mixture includes 5% to 15% (percentage solids) of silicone crosslinking agent.

5. A computer to plate system comprising:

a. means for re-constituting a single layer plate on an existing substrate, said re-constituting means comprising:

i. erasing means for removal of a used imaged coating from a previous job to generate an erased substrate;

ii. mixture means for preparing a mixture;

iii. coating means for coating said prepared mixture on said erased substrate; and iv. solidifying means for solidifying and curing said coated layer;

whereas said coated layer is an infrared absorbing layer, and one of said coated layer and said erased substrate is oleophilic and the other is oleophobic;

b. an imaging system for placing an image on said coated layer; and c. means for cleaning said imaged plate;

wherein said coated layer is formed from said mixture, said mixture including 40% to 80% (percentage solids) of silicone emulsion, 0.01% to 3% (percentage solids) of silicone catalyst, 5–15% (percentage solids) of silicone crosslinking agent and 4%–25% of water soluble crosslinkable amine resin.

6. The system according to claim 5, wherein said mixture further includes 0.5% to 5% of catalyst for the amine resin.

7. The system according to claim 6, wherein said mixture further includes 0.5%–10% of added surfactant.

8. The system according to claim 7, wherein said mixture further includes 3%–40% of infrared absorber.

9. A printing system comprising:

a. a printing member comprising a single imaging layer coated on an image bearing cylinder or on a replaceable substrate attached to said cylinder;

b. an imaging system for placing an image on said image bearing cylinder or substrate; and c. an inking assembly for applying ink to said printing member, whereby, on selective ablation, polymerization or decomposition of said imaging layer, selective areas of said imaging layer are removed thereby exposing said image bearing cylinder or said substrate;

wherein one of said image bearing cylinder or said substrate, and said coated imaging layer is oleophilic and the other is oleophobic;

wherein said imaging layer comprises a mixture including a water soluble crosslinkable amine resin, a catalyst for the amine resin, a silicone emulsion and its crosslinking agent and catalyst, a surface active agent, and an infra-red absorbing agent.

10. The system according to claim 9, wherein said mixture includes 0.5% to 5% of said catalyst for the amine resin.

11. The system according to claim 10, wherein said mixture further includes 0.5%–10% of said surface active agent.

12. The system according to claim 11, wherein said mixture further includes 3%–40% of said infra-red absorbing agent.

13. A printing system comprising:

a. a printing member comprising a single imaging layer coated on an image bearing cylinder or on a replaceable substrate attached to said cylinder;

b. an imaging system for placing an image on said image bearing cylinder or substrate; and c. an inking assembly for applying ink to said printing member, whereby, on selective ablation, polymerization or decomposition of said imaging layer, selective areas of said imaging layer are removed thereby exposing said image bearing cylinder or said substrate;

wherein one of said image bearing cylinder or said substrate, and said coated imaging layer is oleophilic and the other is oleophobic;

wherein said imaging layer comprises a mixture including 40% to 80% (percentage solids) of silicone emulsion, 0.01% to 3% (percentage solids) of silicone catalyst, 5–15% (percentage solids) of silicone crosslinking agent, and 4%–25% of water soluble crosslinkable amine resin.

14. A printing member comprising an image bearing cylinder having a single imaging layer coated thereon, said image bearing cylinder configured such that after selective ablation, polymerization or decomposition of said imaging layer, selective areas of said imaging layer are removed thereby exposing said cylinder;

one of said cylinder and said coated imaging layer is oleophilic and the other is oleophobic;

said coated imaging layer comprises a mixture including a resin and its catalyst, a silicone emulsion and its crosslinking agent and catalyst, a surface active agent, and an infra-red absorbing agent; and said resin is a water soluble crosslinkable amine resin.

15. The printing member according to claim 14, wherein said mixture includes 40% to 80% (percentage solids) of silicone emulsion.

16. The printing member according to claim 15, wherein said mixture further includes 0.01% to 3% (percentage solids) of silicone catalyst.

17. The printing member according to claim 16, wherein said mixture includes 5%–15% (percentage solids) of silicone crosslinking agent.

18. A printing member comprising an image bearing cylinder having a single imaging layer coated thereon, said image bearing cylinder configured such that after selective ablation, polymerization or decomposition of said imaging layer, selective areas of said imaging layer are removed thereby exposing said cylinder;

one of said cylinder and said coated imaging layer is oleophilic and the other is oleophobic;

said imaging layer comprises a mixture including 40% to 80% (percentage solids) of silicone emulsion, 0.01% to 3% (percentage solids) of silicone catalyst, 5–15% (percentage solids) of silicone crosslinking agent and 4%–25% of water soluble crosslinkable amine resin.

19. The printing member according to claim 18, wherein said mixture includes 0.5% to 5% of catalyst for the amine resin.

20. The printing member according to claim 19, wherein said mixture further includes 0.5%–10% of added surfactant.

21. The printing member according to claim 20, wherein said mixture further includes 3%–40% of infrared absorber.

22. A printing member comprising:

a. an oleophobic single coating imaging layer; and b. an oleophilic cylinder surface underlying said imaging layer whereby, on selective ablation of said imaging layer, selective areas of said imaging layer are removed thereby exposing said cylinder surface;

said imaging layer comprises a mixture including a water soluble crosslinkable amine resin and its catalyst, a silicone emulsion and its crosslinking agent and catalyst, a surface active agent, and an infra-red absorbing agent.

23. A printing member comprising:

a. a cylinder, b. an image bearing substrate attached to said cylinder; and c. a single imaging layer coated on said substrate on press, said imaging layer configured for selective ablation, polymerization or decomposition thereof, selective areas of said imaging layer are removed thereby exposing said substrate;

one of said substrate and said coated imaging layer is oleophilic and the other is oleophobic;

said imaging layer comprises a mixture including 40% to 80% (percentage solids) of silicone emulsion, 0.01% to 3% (percentage solids) of silicone catalyst, 5–15% (percentage solids) of silicone crosslinking agent and 4%–25% of water soluble crosslinkable amine resin.

24. The printing member according to claim 23, wherein said mixture includes 0.50% to 5% of catalyst for the amine resin.

25. The printing member according to claim 24, wherein said mixture further includes 0.5%–10% of added surfactant.

26. The printing member according to claim 25, wherein said mixture further includes 3%–40% of infrared absorber.

27. A digital waterless processless plate, having a single imaging layer formed from a formulation comprising a mixture including a surface active agent, an infra-red absorbing agent, 40% to 80% (percentage solids) of silicone emulsion, 0.01% to 3% (percentage solids) of silicone catalyst, 5–15% (percentage solids) of silicone crosslinking agent, 4%–25% of water soluble crosslinkable amine resin and a catalyst for the amine resine.

28. The digital waterless processless plate printing member according to claim 27, wherein said mixture includes 0.5% to 5% of said catalyst for the amine resin.

29. The digital waterless processless plate according to claim 28, wherein said mixture includes 0.5%–10% of said surface active agent.

30. The digital waterless processless plate according to claim 29, wherein said mixture includes 3%–40% of said infra-red absorbing agent.

31. A digital waterless processless plate, having a single imaging layer formed from a formulation comprising a mixture including a water soluble crosslinkable amine resin and its catalyst, a silicone emulsion, a silicone crosslinking agent and a silicone catalyst, a surface active agent, and an infra-red absorbing agent.

32. The digital waterless processless plate according to claim 31, wherein said mixture includes 40% to 80% (percentage solids) of said silicone emulsion.

33. The digital waterless processless plate according to claim 32, wherein said mixture further includes 0.01 to 3% (percentage solids) of said silicone catalyst.

34. The digital waterless processless plate according to claim 33, wherein said mixture further includes 5–15% (percentage solids) of said silicone crosslinking agent.

35. A formulation for a printing plateless member, said formulation comprising a mixture including 40% to 80% (percentage solids) of silicone emulsion, 0.01% to 3% (percentage solids) of silicone catalyst, 5–15% (percentage solids) of silicone crosslinking agent and 4%–25% of water soluble crosslinkable amine resin.

36. The formulation according to claim 35, wherein said mixture further includes 0.5% to 5% of catalyst for the amine resin.

37. The formulation according to claim 36, wherein said mixture further includes 0.5%–10% of added surfactant.

38. The formulation according to claim 37, wherein said mixture further includes 3%–40% of infrared absorber.

39. A formulation for a printing plateless member, said formulation comprising a mixture including a water soluble crosslinkable amine resin and its catalyst, a silicone emulsion and its crosslinking agent and catalyst, a surface active agent, and an infra-red absorbing agent.

* * * * *